US006955444B2

(12) United States Patent
Gupta

(10) Patent No.: US 6,955,444 B2
(45) Date of Patent: Oct. 18, 2005

(54) SURGICAL HEADLIGHT

(75) Inventor: Sushil Gupta, Vestal, NY (US)

(73) Assignee: Visiled, Inc., Vestal, NY (US)

( * ) Notice: Subject to any disclaimer, the term of this patent is extended or adjusted under 35 U.S.C. 154(b) by 0 days.

(21) Appl. No.: 10/706,062

(22) Filed: Nov. 12, 2003

(65) Prior Publication Data

US 2005/0117327 A1 Jun. 2, 2005

(51) Int. Cl.[7] ..... F21V 21/084
(52) U.S. Cl. ..... 362/105; 362/106
(58) Field of Search ..... 362/105–106, 362/103; 363/106

(56) References Cited

U.S. PATENT DOCUMENTS 3,285,242 A * 11/1966 Wallace ..... 600/249
3,645,254 A * 2/1972 Burton ..... 600/249
3,665,451 A * 5/1972 Keith ..... 340/321
3,676,664 A * 7/1972 Corvetti ..... 362/105
3,745,993 A * 7/1973 Feinbloom ..... 600/249
3,828,201 A * 8/1974 Allen, Sr. ..... 307/150
3,830,230 A * 8/1974 Chester ..... 600/249
4,288,844 A * 9/1981 Fisher et al. ..... 362/33
4,631,644 A * 12/1986 Dannhauer ..... 362/105
4,631,645 A * 12/1986 Lenart ..... 362/105
4,794,496 A * 12/1988 Lanes et al. ..... 362/105
5,023,763 A * 6/1991 Le Gars ..... 362/240
5,028,806 A * 7/1991 Stewart et al. ..... 307/66
5,115,382 A * 5/1992 Smith ..... 362/105
5,163,420 A * 11/1992 Van Der Bel ..... 600/249
5,667,291 A * 9/1997 Caplan et al. ..... 362/105
5,722,762 A * 3/1998 Soll ..... 362/105
5,774,271 A * 6/1998 Lagerway et al. ..... 359/649
6,121,695 A * 9/2000 Loh ..... 307/64
6,224,227 B1 * 5/2001 Klootz ..... 362/105
6,283,620 B1 * 9/2001 Taylor et al. ..... 362/474
6,554,444 B2 * 4/2003 Shimada et al. ..... 362/103
6,609,913 B1 * 8/2003 Batts ..... 434/226
2002/0186557 A1 * 12/2002 Lary et al. ..... 362/106
2003/0067769 A1 * 4/2003 Gilpin ..... 362/184
2003/0161152 A1 * 8/2003 Jesurun et al. ..... 362/250

* cited by examiner

*Primary Examiner*—Stephen Husar
*Assistant Examiner*—Jason Han
(74) *Attorney, Agent, or Firm*—Mark Levy & Associates, PLLC; David L. Banner

(57) ABSTRACT

A surgical headlamp containing dual lamp housings, each containing one or more LED light sources is featured. Both lamp housings may be adjusted so that light beams emitted by each may be selectively converged at a spot a predetermined distance in front of the lamp housings. Each lamp housing typically contains, in addition to the LED(s), one or more reflectors to gather and direct light generated by the LED(s) forward to an illuminated work area. Batteries, preferably rechargeable, mounted either on the headband supporting the headlamp on a user's head or external to the headband, are used to power the LED(s). Switch and/or dimming circuitry may be provided. Hot swapping, a capability whereby batteries may be interchanged during a lengthy surgical procedure, is also provided.

12 Claims, 3 Drawing Sheets

SURGICAL HEADLIGHT

BACKGROUND OF THE INVENTION

1. Field of the Invention

The present invention pertains to lights that can be worn on a user's head to provide illumination to an area of work, and, more particularly, to a headlight for surgeons, dentists, or other medical personnel or craftsmen. The light uses two independent lamp housings, working cooperatively to converge light beams at a predetermined distance from the LED light sources.

It is essential in certain medical procedures that the physician, surgeon, or dentist has his or her hands free for manipulating various surgical, diagnostic, or therapeutic instruments. At the same time, the particular part of the patient's body that the physician or surgeon is treating must be adequately illuminated. For these purposes, doctors and surgeons have heretofore utilized surgical headlights, some of which require the user to remain attached via fiber optic cable to a free standing light source, and/or to a power outlet for an energy source.

Battery powered, head mounted lamps utilizing an incandescent lamp as a light have also been used. Typically, the high power consumption, relatively low light output, high weight, and short battery life of such devices of the prior art have made their use difficult, uncomfortable, or otherwise unsatisfactory.

Even with such configurations, however, the amount of light impinging upon the work area can be inadequate. Moreover, to provide adequate illumination, designs of the prior art typically use incandescent lamps, which generate excessive amounts of heat that may dry out patient tissue and cause the surgeon discomfort. Power consumption of incandescent lamps is also high, necessitating relatively short-life, large capacity batteries.

Some of the problems associated with incandescent lamps may be overcome by using light emitting diodes (LEDs). Some prior art apparatus have used relatively high power (e.g., 5 watt) LEDs to generate sufficient light output. Such LEDs typically generate so much heat that a heat sink is required. For a 5 W LED, the heat sink generally must be four times larger than that used for a 1 W LED.

Heat sinks by their very nature are heavy and the added weight on such a heat sink contributes to discomfort for the wearer of the head mounted lamp. In addition, a single light source (i.e., LED) disperses the light beams and may, depending on the nature of the work area, result in obscuring shadows on the work area. Consequently, despite the obvious advantage of a personal, head-mounted light source, the numerous disadvantages and shortcomings of surgical headlamps of the prior art have kept such devices from becoming widely used by surgeons and other medical and dental practitioners.

2. Discussion of Related Art

Several attempts to solve the problems described hereinabove have been made in the prior art. For example, published U.S. patent application 2002/0186557, published Dec. 12, 2002 for HEAD APPARATUS WITH LIGHT EMITTING DIODES by Banning Lary et al., teaches a head mounted lamp assembly with a plurality of LEDs mounted in a rectangular array across the forehead of the wearer. Such an apparatus provides a broad, distributed field of illumination suitable for general work but fails to provide the high-intensity, focused light beam of the apparatus of the present invention.

U.S. Published patent application 2003/0067769, published Apr. 10, 2003 for MULTIPLE LED LIGHT SOURCE by Scott Gilpin, teaches a multi-LED lamp housing for wearing on the head. A single housing contains an array of LEDs but no light directing structure is disclosed. Such an apparatus is again suitable for generalized illumination and the intensity is believed to be higher than the illumination provided by LARY et al. Still, the GILPIN apparatus lacks any focusing mechanism and probably would not provide the high intensity illumination required for surgical or similar applications.

U.S. Published patent application 2003/0161152, published Aug. 28, 2003 for AMBIENT LIGHTING SYSTEM FOR SURGICAL LIGHTS by David Jesurun et al., teaches a LED lighting system for providing ambient light in an operating theater. The light system uses interacting reflectors to direct light from multiple LEDs but does not provide a high intensity, head-mounted, focusable surgical headlamp.

None of the prior art references are seen to teach or suggest, either individually or in any combination, the head mounted, plural LED, focusable surgical headlamp of the present invention.

SUMMARY OF THE INVENTION

In accordance with the present invention, there is provided a surgical headlight that overcomes the problems of head mounted surgical headlamps of the prior art. A pair of lamp housings, each containing one or more low wattage (i.e., approximately 3 watts) LEDs and one or more reflectors, is mounted on an adjustable headband. The lamp housings are pivotally mounted side-by-side at the front of the headband such that each of the lamp housings may be positioned to converge their individual beams at a predetermined point, for example, 14 inches in front of the headlamp.

Rechargeable batteries mounted either on the headband for completely portable operation or on a belt-mounted battery pack or the like are used to power the LEDs. Circuitry is provided so that one battery may be removed and replaced with a freshly charged battery without affecting the light output from the headlamp. Optionally, voltage/current regulations may be used to ensure constant light output.

It is, therefore, an object of the invention to provide a head-mounted, LED based headlamp for use by surgeons or other medical personnel, etc.

It is another object of the invention to provide a head-mounted, LED based headlamp comprising a pair of individual lamp housings mounted adjacent one another and pivotable so that the output light beam of each housing may be converged at a predetermined point.

It is a further object of the invention to provide a head-mounted, LED based headlamp powered by rechargeable batteries.

It is an additional object of the invention to provide a head-mounted, LED based headlamp wherein one rechargeable battery may be exchanged without affecting the light output of the headlamp (i.e., batteries may be hot swapped).

It is another object of the invention to provide a head-mounted, LED based headlamp to provide switching and/or intensity control of the LED light sources.

It is a still further object of the invention to provide a head-mounted, LED based headlamp using one or more reflecting elements to gather the light output of the LEDs and project that light forward.

It is yet another object of the invention to provide a head-mounted, LED based headlamp incorporating a comfortable, adjustable headband.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like components and elements of the apparatus of this invention will bear the same designations or numbering throughout the FIGURES.

DETAILED DESCRIPTION OF THE PREFERRED EMBODIMENT

The present invention provides a surgical headlight, which may be used by surgeons, physicians, dentists, etc., who require a reliable, portable, high-intensity, battery-powered light source. For the sake of brevity, the term surgeon is used hereinafter to refer to any user of the head-mounted headlamp of the invention.

Figure 1:
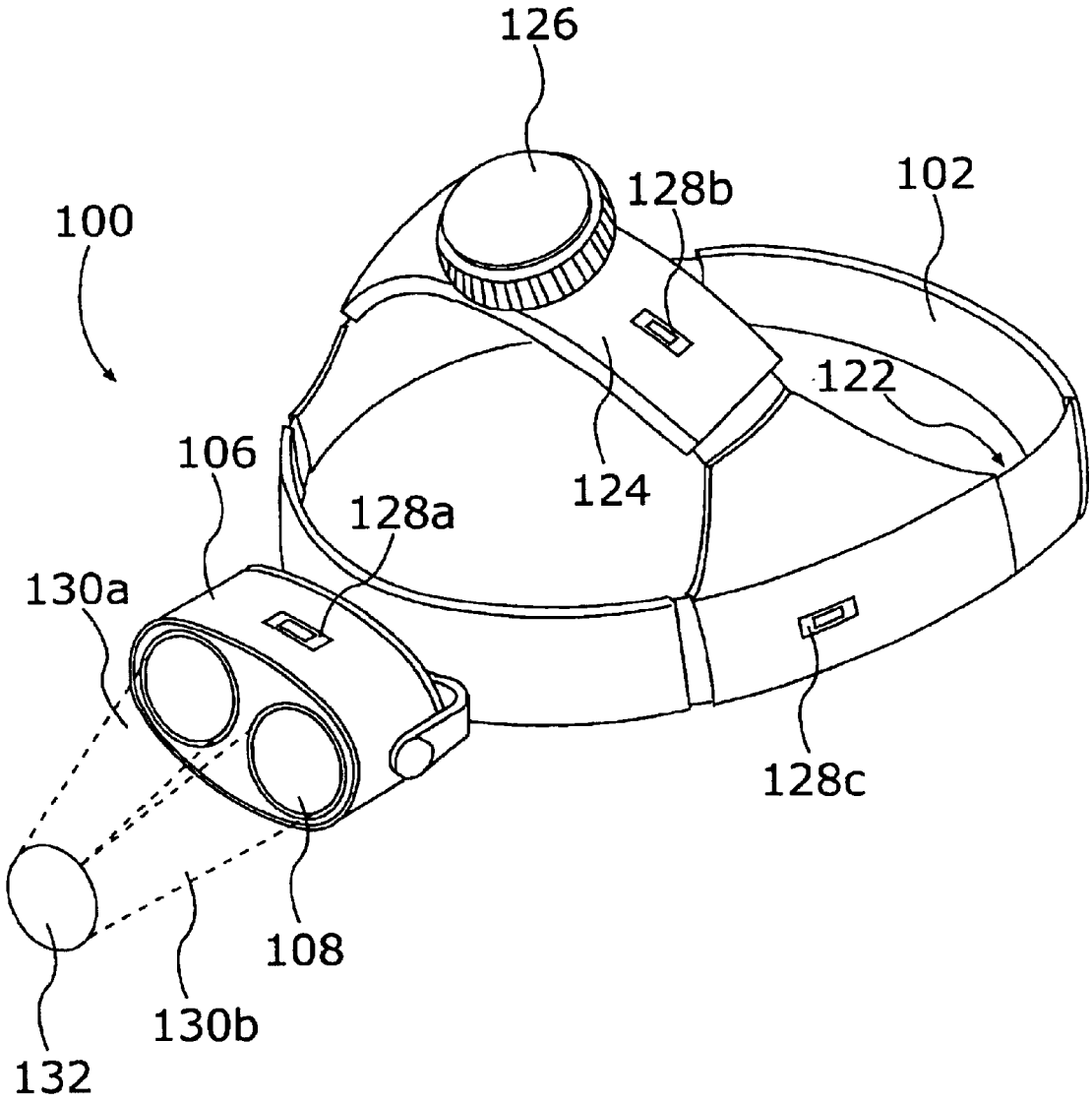
FIG. 1 is a top perspective view of a first embodiment of the surgical headlight in accordance with the invention.

Referring first to FIG. 1, there is shown a top perspective view of a first embodiment of the surgical headlamp 100 of the invention. An adjustable headband 102 is adapted to encircle the head (not shown) of a wearer, thereby supporting the headlamp 100 on the wearer's head. The size of the headband 102 may be secured at a desired diameter to fit the head of the wearer by a locking mechanism. A variety of securing mechanisms that will lock the headband 102 at a desired size are well known to those of skill in the art and the invention is not considered limited to any particular securing mechanism. Headband 102 has an adjustable, over the head support band 124 with a securing mechanism exemplified by a knob 126. As discussed hereinabove, a variety of known securing mechanisms may be used to hold the over the head support 124 as well as the headband 102.

An outer lamp housing 106 is affixed to a central position at the front of the headband 102. The outer housing 106 contains a pair of lamp housings 108, seen in cross-section in FIG. 3. Each lamp housing 108 contains a LED 110 mounted through a rear reflector 112, typically having a parabolic shape. In alternate embodiments, multiple LEDs 110 may be used. It will be recognized that other reflector 112 shapes may be used to accommodate a particular operating requirement or environment. Power to the LED 110 is supplied from a battery (not shown) via power leads 114. A heatsink assembly (not shown) may be required to keep the operating temperature of the LED 110 at an acceptable operating temperature. Further disclosure of LED heatsinks is not considered necessary as they are known to those of skill in the art. Any known heat sinking method and/or configuration may be used with the inventive surgical headlamp.

Figure 3:
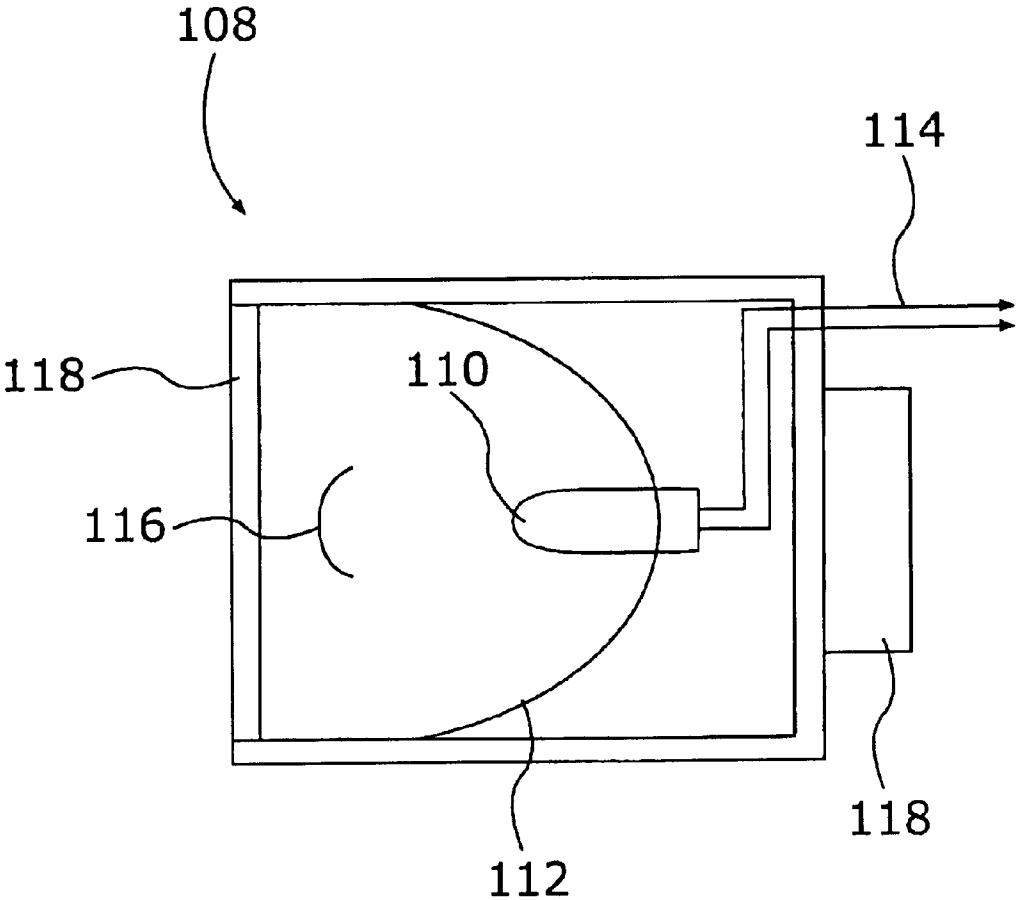
FIG. 3 is a cross-sectional view of a lamp housing suitable for use with the headlamps of FIGS. 1 and 2.

Still referring to FIG. 3, an optional front reflector 116 may be used cooperatively with rear reflector 112 as is also known in the art. A transparent protective lens cover 118 may be used to protect the LED 110 and reflectors 112, 116 from contamination from spattered blood or the like during a surgical procedure.

The lamp housings 108 are mounted to the outer housing 106 by a pivotal mounting mechanism, not shown. The mounting mechanism allows the lamp housings 108 to be independently moved in at least a horizontal plane substantially parallel to an edge of the headband 102. This allows the focused light beams 130*a*, 130*b* formed by the LEDs 110 and reflectors 112, 116 to be converged at a predetermined point 132 in front of the outer housing 106. For example, in vascular surgery, a typical distance is 14 inches. Other distances, of course, may be selected to meet other procedural needs.

In alternate embodiments, lamp housings 108 could be mounted directly to the headband 102, eliminating the need for the outer housing 106.

The use of dual lamp housings 108 provides several advantages over surgical headlights of the prior art. First, two discrete light sources beamed at a target from slightly different angles tend to minimize shadows in the illuminated work area. Second, the use of two smaller wattage LEDs 110 allow for smaller heatsinks, typically allowing the headlamp assembly 100 to weigh less than a similar headlamp assembly with one, higher wattage LED used as a light source. Third, the use of dual LED light sources provides the ability to easily converge the light beams from each at a predetermined, selectable point in front of the lamp housings 108.

For purposes of disclosure, the distance of 14 inches has been chosen. It will be recognized that the mounting mechanism could be designed to allow light beam convergence from the lamp housings 108 at virtually any distance away from the headband 102.

A cushion material 122 may be selectively placed on the inside surface of the headband 102 to provide comfort to the wearer of the headlamp assembly 100.

Figure 2:
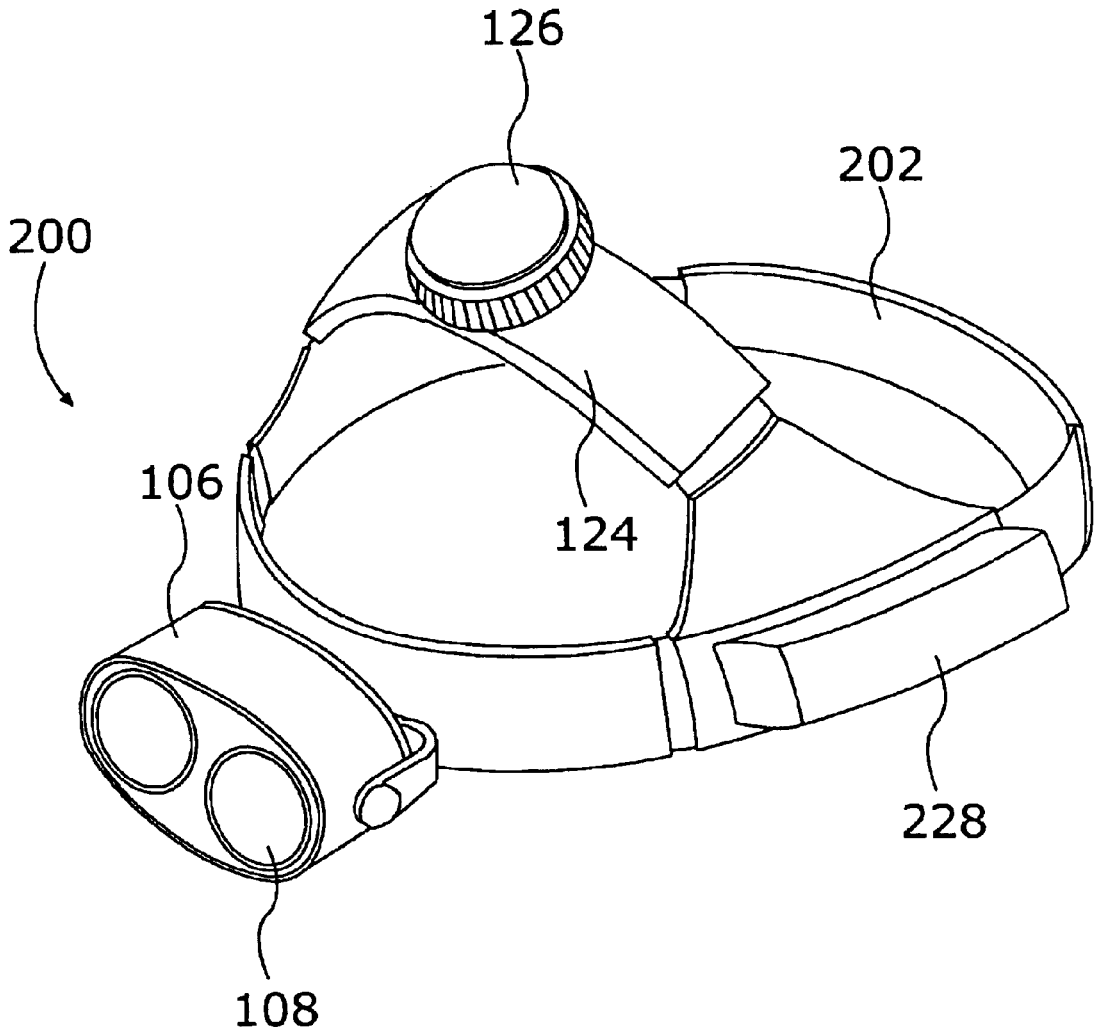
FIG. 2 is a top perspective view depicting an alternate embodiment of the surgical headlamp of the invention.

Referring now also to FIG. 2, there is shown a top perspective view of an alternate embodiment of the inventive surgical headlamp, generally at reference number 200. The overall structure of the surgical headlamp 200 is similar to that of the surgical headlamp 100 as shown in FIG. 1. The headband 202 is adjustable in a similar manner as the headband 102 in FIG. 1. Headband 202 also has an adjustable, over the head support band 124 with a securing mechanism exemplified by a knob 126. As discussed hereinabove, a variety of known securing mechanisms may be used to hold the over the head support 124 as well as the headband 202.

A pair of battery compartments 228 is provided to contain necessary rechargeable batteries on the headband 202. In alternate embodiments, all or additional batteries may be supported on a belt clip supported battery compartment or the like.

It will be recognized that while only two embodiments of the headlamp have been provided for purposes of disclosure, numerous variations are possible. As already stated, each lamp housing 106 may contain more than one LED 110. Different reflector configurations could also be used. Even more than two lamp housings 108 could be used for either higher intensity or to further eliminate shadows in the illuminated work area.

In either of the two embodiments, a single switch 128*a*, 128*b*, 128*c* is shown in three possible locations, respectively. The exact location and/or configuration of switch 128*a*, 128*b*, 128*c* is unimportant as neither the configuration nor location form any part of the instant invention. Switch 128*a*, 128*b*, 128*c* may be readily configured to turn on and off either at the LED(s) 110 of a single lamp housing 108, 208 or simultaneously turn on and off all LEDs 110 of all lamp housings 108. In addition, an intensity varying control could be easily provided so the overall light output could be dimmed when required. Circuitry and other mechanisms for accomplishing dimming of LEDs are known and any such circuitry or mechanism could be employed with the surgical headlamps 100, 200 of the invention. A low battery alarm, either aural or visual, could likewise be provided.

The inventive surgical headlamp has been demonstrated to produce light intensities at approximately 14 inches in the range of approximately 3000–4000 foot candles. This translates to approximately 30,000–40,000 lux, a lux being approximately 10.74 foot candles.

Since other modifications and changes varied to fit particular operating requirements and environments will be apparent to those skilled in the art, the invention is not considered limited to the examples chosen for purposes of disclosure and covers all changes and modifications which do not constitute departures from the true spirit and scope of this invention.

Having thus described the invention, what is desired to be protected by Letters Patent is presented in the subsequently appended claims.

What is claimed is:

1. A headlight for use by surgeons comprising:

a) an adjustable headband for placing on a user's head;

b) at least two forward-facing, independently movable lamp housings, each comprising at least one light emitting diode (LED), a heat sink, and at least one reflector, disposed adjacent one another within an outer lamp housing disposed substantially centrally on a front side of said headband; and c) at least two batteries disposed on said headband and operatively connected to said at least one LED, and adapted for independent replacement in a manner such that light output from said at least one LED is maintained during and independent replacement of one of said at least two batteries, said at least two batteries being the sole source of electrical power to said at least one LED.

2. The headlight as recited in claim 1, wherein said at least two forward-facing lamp housings are independently pivotally affixed thereto, whereby light output from each of said at least one LED in each of said lamp housings may be converged at a spot a predetermined distance forward therefrom.

3. The headlight as recited in claim 2, wherein said lamp housings further comprise means for focusing light from said at least one LED.

4. The headlight as recited in claim 1, wherein said at least one reflector comprises a reflector disposed behind said at least one LED and a reflector placed forward of said at least one LED, said reflectors arranged so as to cooperatively gather light output from said at least one LED and project said gathered light in a forward direction.

5. The headlight as recited in claim 4, wherein said at least one of said reflectors comprises a substantially parabolic shape.

6. The headlight as recited in claim 2, wherein said adjustable headband comprises means for adjusting said headband to fit any user.

7. The headlight as recited in claim 2, further comprising means for controlling light outpout from at least one of said LEDs.

8. The headlight as recited in claim 7, wherein said means for controlling light output from at least one of said LEDs comprises at least one of the devices: a switch, means for varying the intensity of said at least one LED.

9. The headlight as recited in claim 1, wherein said at least two batteries further comprise means for regulating power from said at least two batteries to maintain substantially constant light output from said at least one LED disposed in said at least two lamp housings.

10. The headlight as recited in claim 2, further comprising cushioning means disposed proximate an inside surface of said headband.

11. The headlight as recited in claim 4, wherein said headlight produces a light output having an intensity of approximately 40,000 lux.

12. The headlight as recited in claim 1, further comprising a supplemental battery operatively connected to said at least two batteries and disposed a part therefrom.

* * * * *